US008382542B2

(12) United States Patent
Pakhomov

(10) Patent No.: US 8,382,542 B2
(45) Date of Patent: Feb. 26, 2013

(54) TWO FIN SWIMMING APPARATUS

(76) Inventor: Dmitriy Viacheslavovich Pakhomov, Kraskovo (RU)

( * ) Notice: Subject to any disclaimer, the term of this patent is extended or adjusted under 35 U.S.C. 154(b) by 133 days.

(21) Appl. No.: 12/942,225

(22) Filed: Nov. 9, 2010

(65) Prior Publication Data

US 2011/0111655 A1 May 12, 2011

(30) Foreign Application Priority Data

Nov. 11, 2009 (RU) ..... 2009141540

(51) Int. Cl.
*A63B 31/11* (2006.01)
*A63B 31/10* (2006.01)

(52) U.S. Cl. ..... 441/61; 128/201.11; 441/56

(58) Field of Classification Search ..... 441/55, 441/56, 57, 58, 64, 60, 61, 62, 63; 128/201.11, 128/201.27, 201.28
See application file for complete search history.

(56) References Cited

U.S. PATENT DOCUMENTS

| | | | | | |
|---|---|---|---|---|---|
| 3,529,313 | A | * | 9/1970 | Girden | 441/58 |
| 4,781,637 | A | * | 11/1988 | Caires | 441/64 |
| 5,348,503 | A | * | 9/1994 | Fechtner | 441/56 |
| 5,429,536 | A | * | 7/1995 | Evans | 441/64 |
| 5,649,845 | A | * | 7/1997 | Fechtner | 441/56 |
| 5,664,558 | A | * | 9/1997 | Wagner | 128/201.11 |
| 6,086,440 | A | * | 7/2000 | Fechtner | 441/64 |

* cited by examiner

*Primary Examiner* — Lars A Olson

(74) *Attorney, Agent, or Firm* — Preston Smirman; Smirman IP Law, PLLC

(57) ABSTRACT

The swimming apparatus pertains to swimming with special equipment for swimmers and divers and can be used for increasing speed, comfortable maneuvering, and making swimming more economical. The swimming apparatus comprises a tail fin, a hand-held fin and a dual snorkel.

11 Claims, 7 Drawing Sheets

TWO FIN SWIMMING APPARATUS

CROSS-REFERENCE TO RELATED APPLICATION

This U.S. patent application claims priority under 35 U.S.C. 119 (a) through (d) of Russian Federation utility application RU 2009141540 filed on Nov. 11, 2009, hereby entirely incorporated by reference.

BACKGROUND OF THE INVENTION

The swimming apparatus pertains to swimming with special equipment for swimmers and divers and can be used for increasing speed, comfortable maneuvering, and making swimming more economical. The swimming apparatus comprises a tail fin, a hand-held fin and a dual snorkel.

The disadvantage of ordinary fins or monofins is low swimming efficiency because of imperfect hydrodynamics caused by the elongated form and the flatness of the fin blade.

When water flows over the fin while stroking, there is a stalling (turbulence) on the fin/monofin surface which causes a low ratio between the momentum and the general stroke effort. This is the reason for the lower swimming speed and faster fatigue while kicking intensively with the fins/monofin.

The engineering solution suggested employs a special fin—a tail fin which has better hydrodynamics than the monofin. The tail fin parameters are made to reach the best ratio between the momentum and the general stroke effort. The tail fin is used together with the hand-held fin. The hand-held fin is intended for stabilizing the upper part of body, maneuvering and increasing speed when swimming with the tail fin.

For breathing while swimming along the surface the swimming apparatus provides the dual snorkel that avoids rebreathing exhaled carbon dioxide.

SUMMARY OF THE INVENTION

The invention utilizes the fact that a fin in the shape of a wing provides a better ratio between the momentum and the general stroke effort than a fin with a flat blade. The tail fin is the part of the swimming apparatus that utilizes this advantage.

The solution is reached by the following:

The tail fin length (transverse direction towards the movement) is several times larger than its width (lengthwise direction towards the movement). The tail fin cross-section has a shape which provides optimal ratio of the lift on the surface to the resistance. The fin ends are pointed or have a rectangular shape with flank limiters.

The tail fin is connected to the shoes by a hinge or some flexible connection.

The tail fin is made with the possibility to swing towards the shoes meanwhile the angle of swinging is limited by the regulated stoppers placed on the shoes' keels.

The shoes are joined together by bars; the shoe sole is rigid or semi-rigid.

The tail fin is rigid or has a certain degree of flexibility by means of a supple material with a rigid frame.

The hand-held fin is an essential part of the swimming apparatus (written hereafter as "apparatus") as a stabilizer of the upper part of body when swimming with the tail fin. At the same time, it can naturally serve for maneuvering. As a result, it enhances speed, comfort and the entertaining aspect of swimming with the apparatus.

The solution is reached by implementing the hand-held fin in variants as follows:

a wing-shaped horizontal fin held with hands on the front edge and additionally fixed by holders at the wrists;

a horizontal fin consisting of two halves connected by an axis; additionally, vertical upper and lower fins may be attached to the horizontal fin either to one of the halves or each one to each of the halves;

a compound fin placed nearer to the elbows and consisting of the horizontal and vertical upper and lower fins held with the hands on the handles connected with the fin combination by a bar, and fixed at the arms by the holders placed under the horizontal fin. The horizontal fin consists of the immovable middle part placed above arms, the right and left parts connected with the middle one by axes. The compound fin may be configured with the two vertical upper fins or with single one.

A means of breathing should be provided so that one can swim with the apparatus along the surface. The point is that the depth is greater, when swimming with the apparatus, than that with ordinary fins and, consequently, a longer snorkel is required. An ordinary snorkel has a zone of exhaled carbon dioxide inside the tube and, therefore, the reasonable length of it is limited. The suggested engineering solution, the dual snorkel, serves the purpose of facilitation of swimmers' respiration by avoiding the breathing "dead zone" (exhaled carbon dioxide) for snorkels of any length, providing the possibility of making a longer tube than an ordinary one.

The solution is achieved by providing the snorkel tube with channels for the inhale and the exhale separated over the whole length, the valves for each channels placed near the mouth-piece. The valves may be done in the manner of flexible petals placed on the different sides of the frame with the holes for the air flow.

The hand-held compound fin may be provided with a built in dual snorkel.

DETAILED DESCRIPTION

Figure 1:
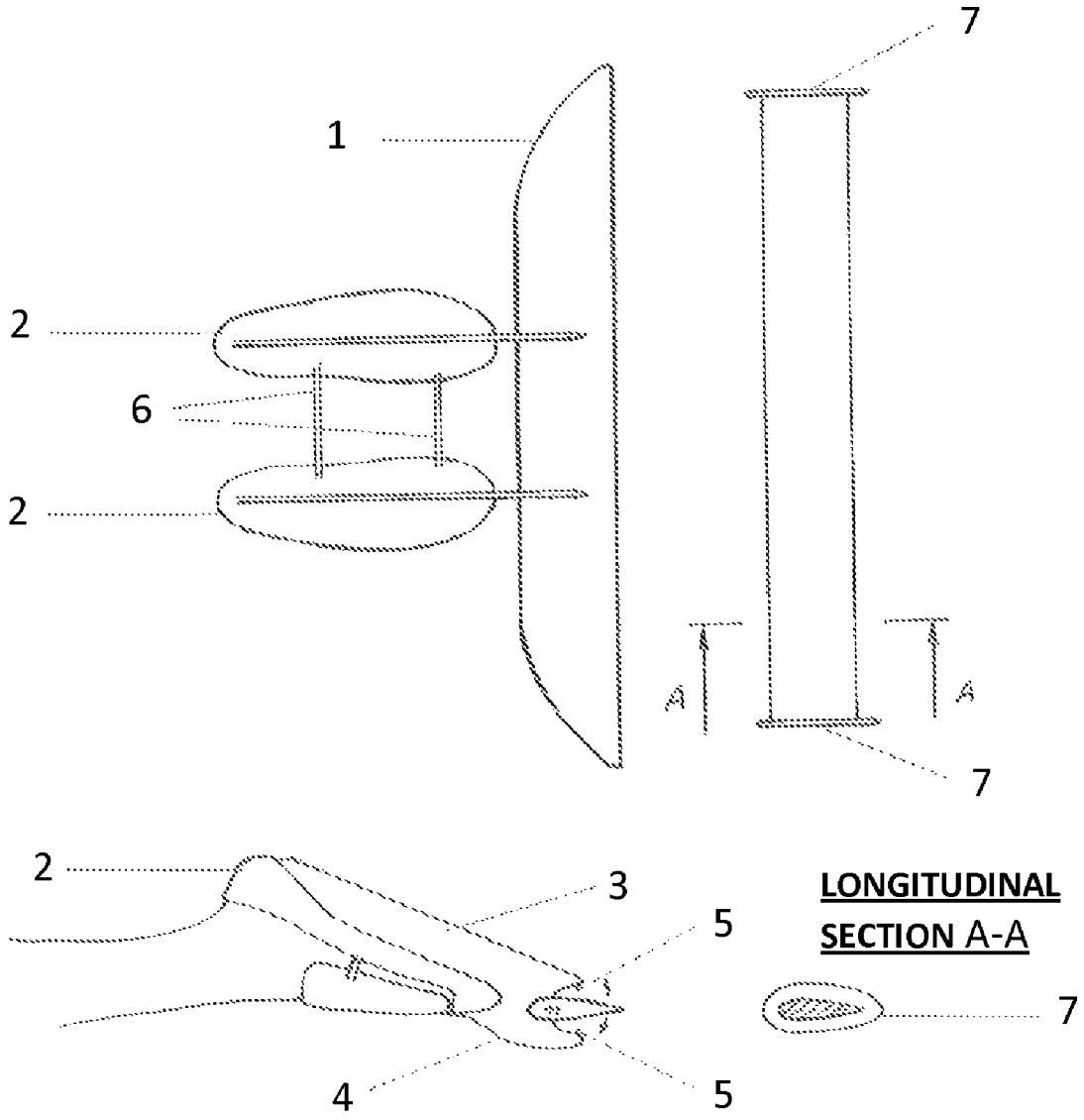
FIG. 1 illustrates a general view of a tail fin and shoes.

The swimming apparatus pertains to swimming with special equipment and can be used for increasing speed, comfortable maneuvering, and making swimming more economical. It is intended for entertainment and sports.

The objective of the invention is to provide a quicker means of swimming than ordinary fins and monofins. The tail fin serves the purpose of optimizing the kick more than ordinary fins. The tail fin characteristics are fulfilled to achieve the optimal ratio of momentum to the general stroke effort. The tail fin length (transverse direction towards the movement) is several times larger than its width (lengthwise direction towards the movement). The tail fin cross-section has a shape which provides the optimal ratio of lift (which appears on the fin surface while water flows over the fin) to resistance. The tail fin construction allows one to achieve a maximum effect for both a downstroke and an upstroke because it sets an optimal attack angle of the tail fin towards the incoming flow for either direction of the kick. The tail fin is supposed to be exercised in a dolphin-like style of swimming. It can be used for both comfortable and intensive, sport-like manners of kicking.

Although it is preferable when a tail fin has a better ratio between lift and resistance and other characteristics that enhance the efficiency of the tail fin—it is a matter of hydrodynamics—the apparatus proves its sufficient efficiency when used with less optimal characteristics too.

The methods of implementation of the tail fin are various. The tail fin may be produced as the rigid variant or have a certain degree of flexibility. In case of a flexible variant, the tail fin is made of flexible material, for example, rubber, in combination with a rigid frame. The frame parts have the ability to turn around an axis. Under the pressure of the incoming water flow, the tail fin changes shape in a way that is best for the smooth water flowing over the fin and the ratio between the lift and the resistance.

Despite the evident advantage of the said tail fin, a problem prevents the use of it alone—the swinging of the upper part of body while kicking with the tail fin. The movement appears to be significant, however, the forward progress remains unaffected, if not inhibited. The lift created on the fin surface has an angle towards the actual direction of swimming. The cross vector of the lift causes such an effect that when a swimmer makes a downstroke his upper part of body bends downwardly and when an upstroke it bends upwardly. The more effort of stroke, the more swinging of the upper part of body. As a result, the effect of the tail fin use is destroyed.

The problem is solved by use of the hand-held fin held with the hands stretched forward in front of the head. Its starting version is implemented as a horizontal fin. Preferably, it also has the shape of a wing because lift created on its surface is one that suppresses swinging of the upper part of body. A better ratio of lift to resistance is important for the had-held fin too. The horizontally stabilizing function of the hand-held fin is the main one. At the same time, naturally, it can serve for directional steering and banking while swimming. The full advantage of it is taken when the hand-held fin is provided with vertical fins attached to the horizontal one and different parts of the hand-held fin are made with the ability to move/turn towards each other.

For a logical completion of the apparatus, a means of breathing should be provided so that one can swim with the apparatus along the surface. An ordinary snorkel can hardly be useful for this case since the depth of swimming with the apparatus is greater than that with ordinary fins. The swimmer's body and the fins should be completely covered by water while kicking. Besides, the swimmer's head may swing in a certain degree. Also, the head is positioned lower for smoother water flow over the body. A snorkel that is longer than an ordinary one by at least 30-35 centimetres is required. Such an additional length is unattainable for an ordinary snorkel since it is single-channeled and has the zone of exhaled carbon dioxide inside the tube and reasonable length of it is limited. The suggested engineering solution, the dual snorkel, serves the purpose of avoiding the breathing "dead zone" (exhaled carbon dioxide) regardless of the snorkel length and, consequently, providing the possibility of making a longer tube than an ordinary one.

The solution is achieved by providing the snorkel tube with channels for the inhale and the exhale separated over the whole length, the valves for each channels placed near the mouth-piece. The valves ensure the inhaled and the exhaled air move strictly along the relative channels. The valves may be done in the manner of flexible petals placed on the different sides of the frame with the holes for the air flow.

FIG. 1 illustrates a general view of a tail fin and shoes. A tail fin 1 is fixed to shoes 2 by hinges or some flexible connection. The tail fin 1 can swing towards the shoes 2 up and down on a certain angle with intent that the fin takes the position of attack angle towards the incoming flow necessary for creating optimal momentum. The angle of the tail fin swing is limited by regulated stoppers 5 placed on a lower 3 and an upper 4 keels of the shoes 2. The angle of swing is selected for a person individually. It depends on the angle a foot takes relative to an ankle in a stretched position. The shoes 2 are joined by bars 6 ensuring the needed inflexibility of fixture under a condition of minimal water resistance. The shoe sole is rigid or semi-rigid. In any case, the shoes' design has to ensure the certain attack angle that the tail fin takes towards the incoming flow. The lower shoe keels 3 also fulfills the function of support on which one is able to stand or push off from the swimming pool wall. The tail fin 1 may have different shapes. For example, the fin ends may be pointed or have a rectangular shape with the flank limiters 7 and others. The object for having a certain tail fin shape is providing optimal momentum for the particular conditions of diving.

Figure 2:
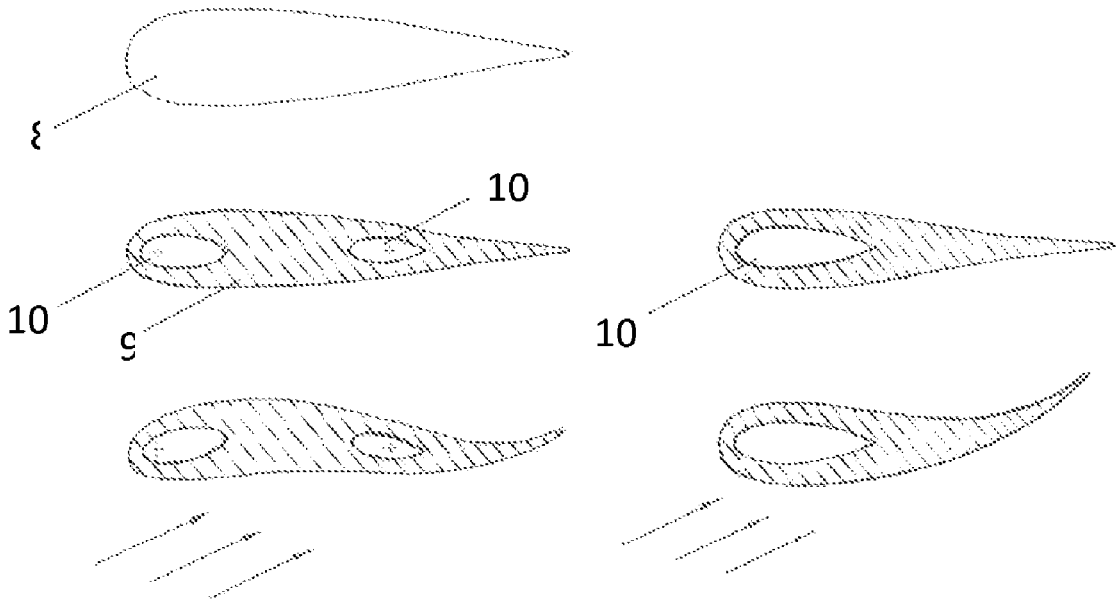
FIG. 2 illustrates tail fin types—a rigid variant and a flexible variant with a rigid frame.

FIG. 2 illustrates tail fin types—a rigid variant 8 and a flexible variant with a rigid frame. In case of a flexible variant, the tail fin is made of flexible material 9, for example, rubber, in combination with a rigid frame 10. The frame parts are placed along the length of tail fin to ensure the inflexibility in this direction. The frame parts have the ability to turn around an axis. Under the pressure of the incoming water flow, the tail fin changes shape in a way that is best for the smooth water flowing over the fin and the ratio between the lift and the resistance.

Materials for producing the fin and the shoes: plastic, rubber, carbon, steel for strengthening the shoes and the hinges.

Figure 3:
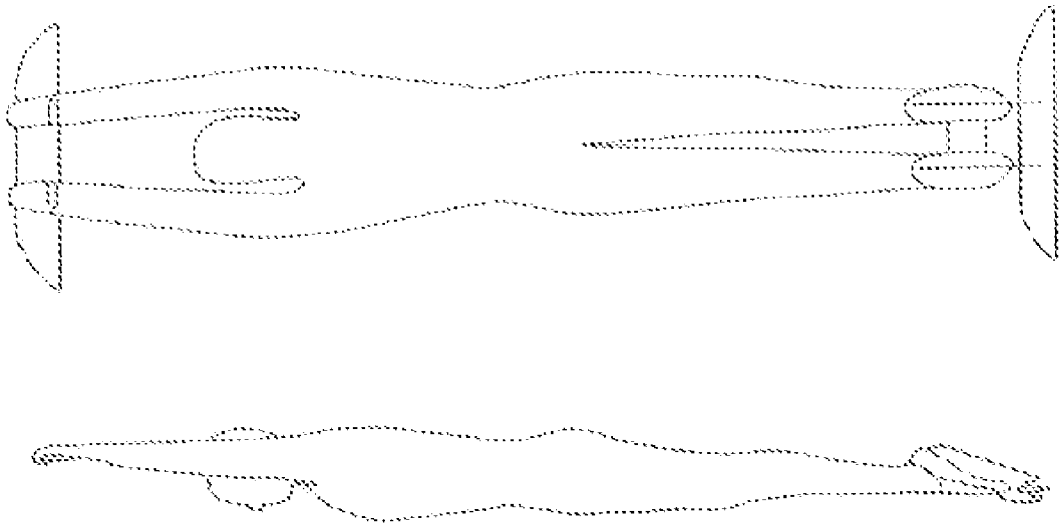
FIG. 3 illustrates using of a hand-held fin in the shape of a wing in combination with a tail fin.

FIG. 3 illustrates using of a hand-held fin implemented as a horizontal fin in the shape of a wing in combination with a tail fin. This is a starting version of a hand-held fin. It is best for speedy swimming. As previously mentioned, the effective application of a tail fin suggests using it together with a hand-held fin. A swimmer applies a dolphin-like manner of moving the body when swimming with the apparatus.

Figure 4:
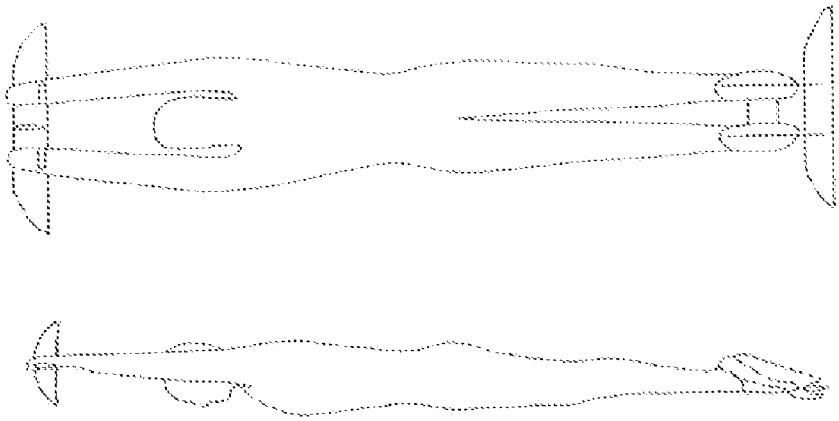
FIG. 4 illustrates using of a hand-held fin consisting of two horizontal halves and vertical fins in combination with a tail fin.

FIG. 4 illustrates using of a hand-held fin consisting of two horizontal halves and vertical fins in combination with a fin. Vertical upper and lower fins are attached to the horizontal fin either to one of the halves or each one to each of the halves. Such an improvement provides effective means for directional steering and banking in addition to the horizontally stabilizing of the upper part of body.

Figure 5:
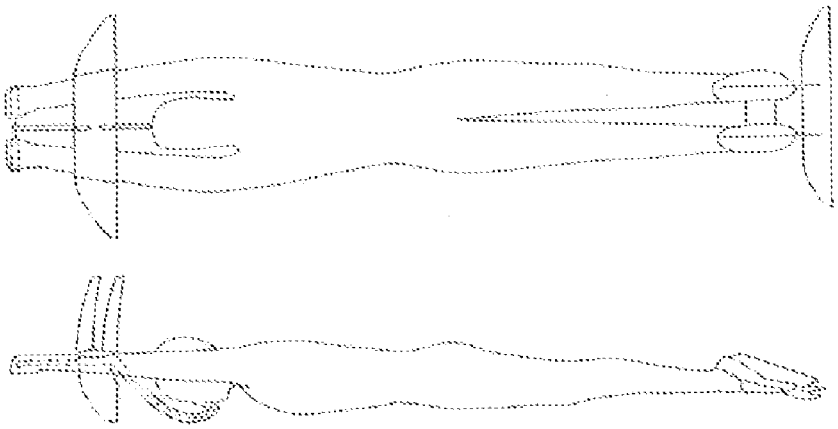
FIG. 5 illustrates using of a compound fin with a built in dual snorkel in combination with a tail fin.

FIG. 5 illustrates using of a hand-held fin implemented as a compound fin with a built in dual snorkel in combination with a tail fin. The compound fin consists of the horizontal and vertical fins together. It is placed nearer to the elbows. The leverage of forces applied to a compound fin is less than when a hand-held fin is held with hands on the front edge. Consequently, the strain in swimmer's arms and shoulders is less too. Also, the compound fin provides an alternate method of controlling the fin movable parts—by handles. There is a possibility to build in a dual snorkel in the compound fin since it is close to the swimmer's head. Inhale and exhale channels are set in a vertical upper fin(s).

Figure 6:
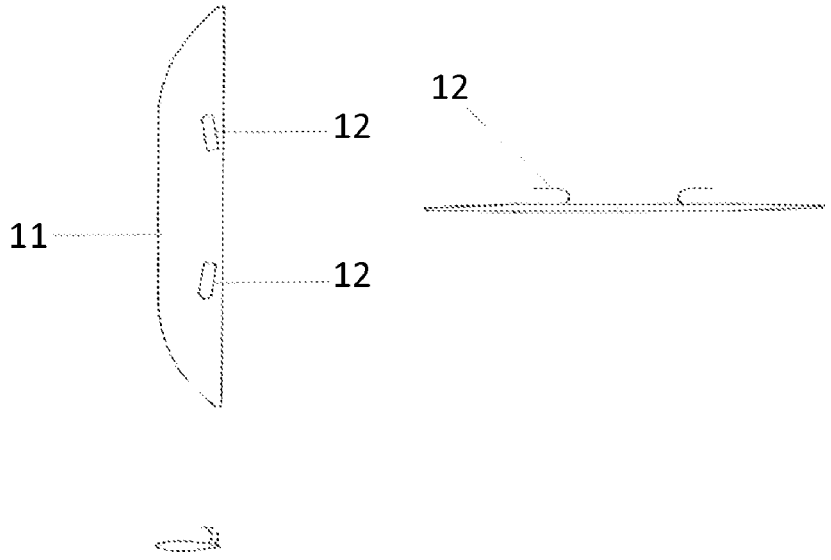
FIG. 6 illustrates a hand-held fin implemented in the shape of a wing.

FIG. 6 illustrates a hand-held fin implemented as a horizontal fin 11 in the shape of a wing and held with the swimmer's hands on the front edge. The fin position is additionally secured by the holders 12 at the wrists. Lift created on its surface is one that suppresses the swinging of the upper part of body. Such a ratio of lift to resistance is important for a hand-held fin too.

Figure 7:
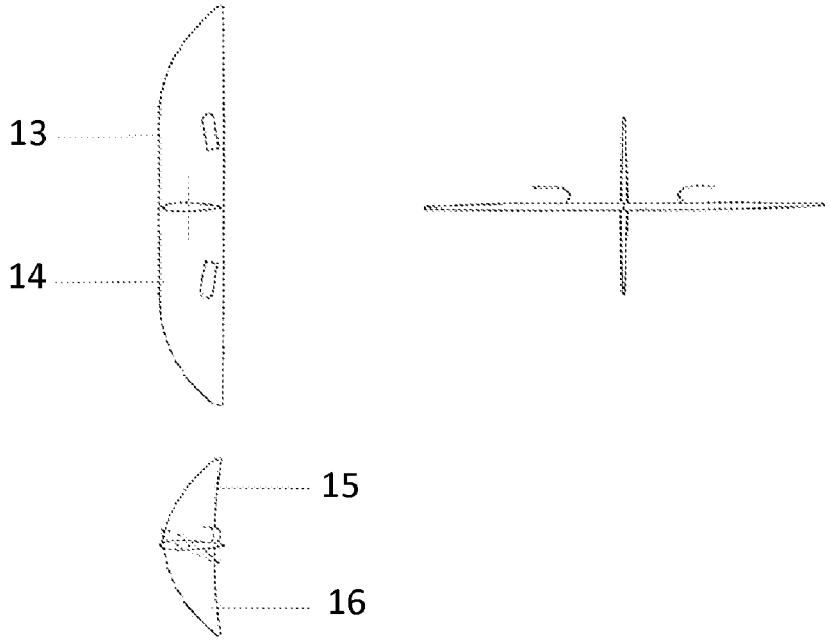
FIG. 7 illustrates a hand-held fin consisting of two halves with vertical fins attached.

FIG. 7 illustrates a hand-held fin implemented as a horizontal fin consisting of a right 13 and a left 14 halves joined to each other by an axis. Vertical fins 15 and 16 are attached to the horizontal fin either to one of the halves or each one to each of the halves 13, 14. The right and the left parts can turn around the axis either way having different angles of attack towards the incoming water flow which allows one to control the bank and turning.

Figure 8:
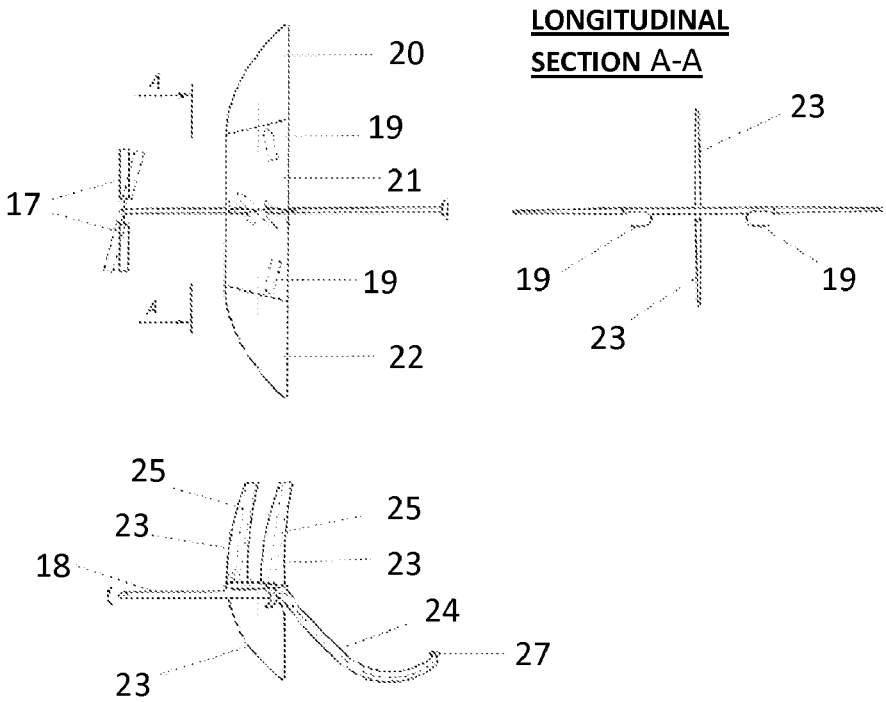
FIG. 8 illustrates a hand-held compound fin with two vertical upper fins and a built in dual snorkel.
Figure 9:
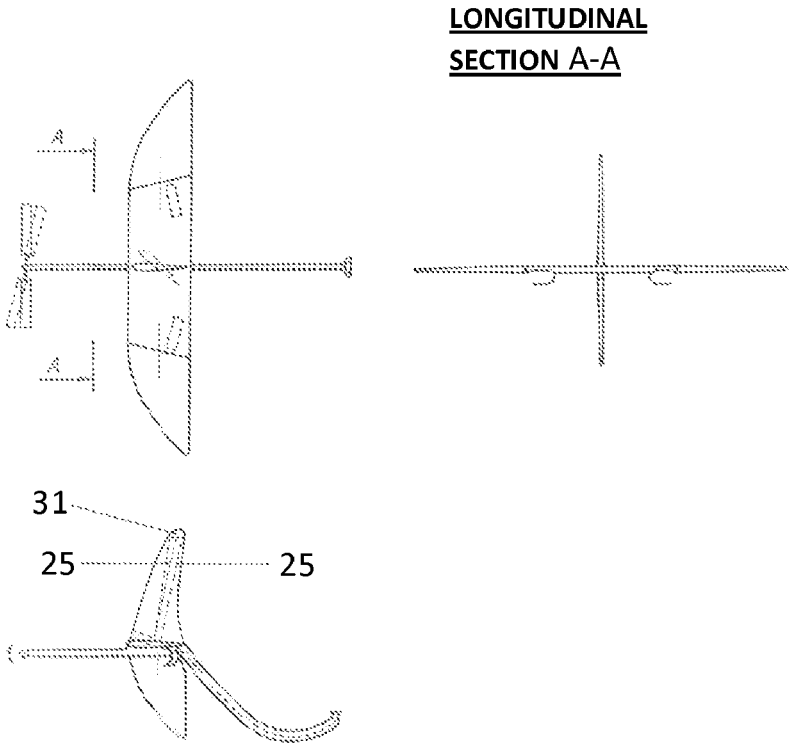
FIG. 9 illustrates a hand-held compound fin with one vertical upper fin and a built in dual snorkel.

FIG. 8 and FIG. 9 illustrate a hand-held compound fin with two and a single vertical upper fins and a built in dual snorkel. The compound fin is held with the hands on handles 17 attached to the fin combination by a bar 18, and additionally fixed at the arms by holders 19 placed under a horizontal fin middle part 21. The swimmer steers the fin by the handles 17. The horizontal fin consists of a right 20, a middle 21 and a left 22 parts. The middle part 21 is placed above the arms and is immovable. The right 20 and left 22 parts are joined to the middle part 21 by axes and can be turned up and down independently of each other. Vertical upper and lower fins 23 are joined to the middle part by axes and can be turned to the right and the left synchronously.

Materials for producing the fin: plastic, rubber, carbon, steel.

A dual snorkel may be built in a hand-held compound fin or may be implemented as a separate component of the apparatus as well.

Figure 10:
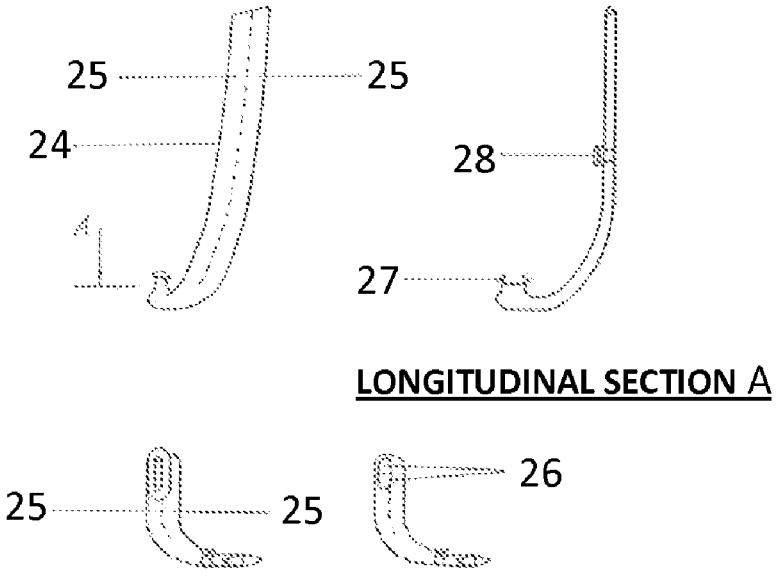
FIG. 10 illustrates a dual snorkel.
Figure 11:
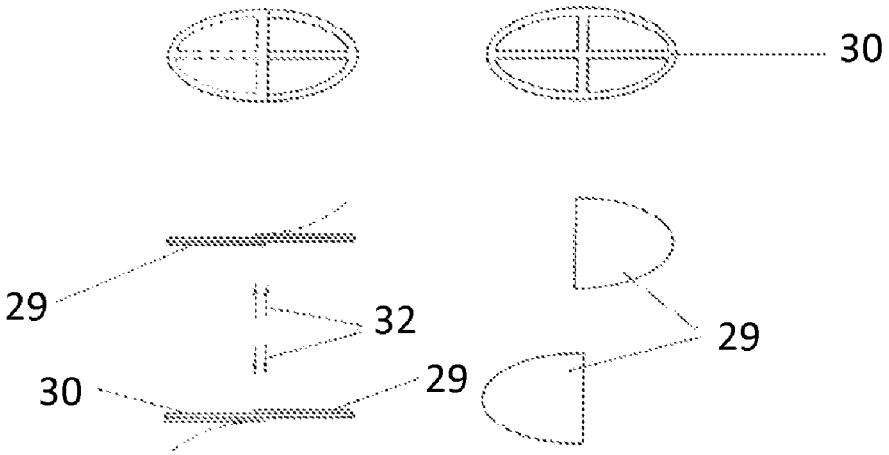
FIG. 11 illustrates a petal valve.

FIG. 10 and FIG. 11 illustrates a dual snorkel and a petal valve. The dual snorkel consists of the tube 24 with an inhale and an exhale channels 25, valves 26, a mouthpiece 27 and a fastening 28 to the mask in the case of the snorkel being a separate part of equipment. The inhale and the exhale channels 25 are independent at all tube lengths. The valves are placed near the mouthpiece. The valves may be done in the manner of flexible petals 29 placed on different sides of a frame 30 with holes for the air flow. The snorkel may be provided with a dry top 31 and a purge valve. When the air does not move, the frame holes are closed by the valves. Depending on the direction of the air flow 32 a certain valve opens letting the air move through the holes. The valves ensure the inhaled and the exhaled air move strictly along the relative channels. The dual snorkel provides the breathing with the clean air without the exhaled carbon dioxide and can be longer than an ordinary snorkel.

The invention claimed is:

1. A swimming apparatus for use with a swimmer's hands, elbows, arms and/or feet, comprising:

a tail fin system including a pair of shoes attached to a tail fin member by at least one keel member positioned between the tail member and the pair of shoes such that the pair of shoes do not directly contact the tail fin member;

a hand-held fin system selectively operable to be held with the swimmer's hands;

a dual snorkel system including a tube system including an inhale channel and an exhale channel, at least one valve member and a mouthpiece member;

wherein a length of the tail fin member is larger than a width of the tail fin member;

wherein the tail fin member is selectively operable to pivot about the keel member towards the pair of shoes;

wherein the pair of shoes are held in fixed relationship to each other;

wherein the hand-held fin system includes a hand-held fin member selectively operable to include at least one fixed or moveable angular portion thereof;

wherein the inhale and exhale channels of the dual snorkel system are independently operable along a length of the tube member such that the valve member is selectively operable to permit any air inhaled by the swimmer to only travel through the inhale channel and any air exhaled by the swimmer to only travel through the exhale channel.

2. The apparatus according to claim 1, wherein a sole of the pair of shoes is formed of either a rigid or semi-rigid material.

3. The apparatus according to claim 1, wherein the tail fin system is formed of either a rigid or semi-rigid material including flexible or/and resilient parts or/and relatively rigid parts.

4. The apparatus according to claim 1, wherein either an amount or angle of the pivot of the tail fin member towards the pair of shoes is either fixed or adjustable when the swimmer is swimming.

5. The apparatus according to claim 1, wherein the hand-held fin member is configured as a wing-shaped horizontal fin member.

6. The apparatus according to claim 1, wherein the hand-held fin system is configured as a horizontal fin system including two portions interconnected therebetween.

7. The apparatus according to claim 6, wherein a vertical upper fin member and a vertical lower fin member are fixed to the hand-held fin system at either one of the two portions.

8. The apparatus according to claim 1, wherein the hand-held fin system is configured as a compound system and includes a combination of a first portion placed near the swimmer's elbows including horizontal and vertical upper and vertical lower fin members that are selectively operable to be held together with the swimmer's hands on a handle member connected to the combination by a bar member, and a second portion fixed to the swimmer's arms by a holder member located under the horizontal fin member, wherein the horizontal fin member includes an immovable middle part set above the swimmer's arms including right and left portions connected to the middle part.

9. The apparatus according to claim 8, wherein the hand-held fin system is configured with two vertical upper fin members.

10. The apparatus according to claim 1, wherein the dual snorkel system is built in the hand-held fin system.

11. A swimming apparatus for use with a swimmer's hands, elbows, arms and/or feet, comprising:

a tail fin system including a pair of shoes attached to a tail fin member by at least one keel member positioned between the tail member and the pair of shoes such that the pair of shoes do not directly contact the tail fin member;

a hand-held fin system selectively operable to be held with the swimmer's hands;

a dual snorkel system including a tube system including an inhale channel and an exhale channel, at least one valve member and a mouthpiece member;

wherein a length of the tail fin member is larger than a width of the tail fin member;

wherein the tail fin member is selectively operable to pivot about the keel member towards the pair of shoes;

wherein the pair of shoes are held in fixed relationship to each other;

wherein the hand-held fin system includes a hand-held fin member selectively operable to include at least one fixed or moveable angular portion thereof;

wherein the inhale and exhale channels of the dual snorkel system are independently operable along a length of the tube member such that the valve member is selectively operable to permit any air inhaled by the swimmer to only travel through the inhale channel and any air exhaled by the swimmer to only travel through the exhale channel;

wherein the dual snorkel system is built in the hand-held fin system.

* * * * *